United States Patent [19]

Demeter et al.

[11] Patent Number: 4,872,397

[45] Date of Patent: Oct. 10, 1989

[54] PERSONAL ENVIRONMENTAL MODULE

[75] Inventors: Michael G. Demeter, St. Francis; Paul E. Wichman, Brookfield; Linda S. Endres; Charles E. Rohrer, both of Milwaukee, all of Wis.

[73] Assignee: Johnson Service Company, Milwaukee, Wis.

[21] Appl. No.: 276,698

[22] Filed: Nov. 28, 1988

[51] Int. Cl.[4] ..... F24F 7/06

[52] U.S. Cl. ..... 98/31.6; 98/38.7; 98/38.9; 98/40.19; 98/DIG. 10; 236/49.5

[58] Field of Search ..... 98/34.5, 34.6, 38.6, 98/38.7, 38.9, 40.19, DIG. 7, DIG. 10, 115.3; 236/49 D; 312/236

[56] References Cited

U.S. PATENT DOCUMENTS

| | | | |
|---|---|---|---|
| 3,378,198 | 4/1968 | Otto | 98/38.7 X |
| 3,951,205 | 4/1976 | Zilbermann | 98/38.9 X |
| 4,646,966 | 3/1987 | Nussbaum | 98/38.9 X |

FOREIGN PATENT DOCUMENTS

| | | | |
|---|---|---|---|
| 828997 | 2/1960 | United Kingdom | 98/38.6 |

*Primary Examiner*—Harold Joyce
*Attorney, Agent, or Firm*—Foley & Lardner

[57] ABSTRACT

A personal environmental module for controlling the environment in a work space, the module including a housing having an air inlet and a pair of air outlets, a pair of dampers mounted in the air inlet, one of the dampers being connected to a preconditioned air source, the other damper being connected to room air, a pair of fans mounted in the housing in a position to allow air through the dampers, a controller for controlling the speed of the fans and the amount of air flowing through the dampers and a control panel operatively connected to the controller for setting the speed of the fan and the temperature of the air discharged through the outlets. A baffle is provided in the housing to direct a portion of the air from each fan into the air flowing from the other fan in order to mix preconditioned air with the room air. An electrostatic filter and white noise generator can be mounted in the housing and a light sensor and occupant sensor operatively connected to the controller.

20 Claims, 3 Drawing Sheets

PERSONAL ENVIRONMENTAL MODULE

BACKGROUND OF THE INVENTION

1. Field of the Invention

The present invention relates to personalized environmental modules which provide for individualized control of the environment of an individuals' work space.

2. Description of the Prior Art

Control of the heating, ventilating and air conditioning (HVAC) of commercial buildings is commonly controlled by a central system. Inefficiencies in these systems are well known in that the entire building or entire floor are provided with the same air flow, whether hot or cold, even though the building or floor cannot be evenly heated or cooled. When different locations in a building or even in a single room are not equally cooled or heated, discomfort leading to complaints can often result in loss of productivity. Entire floors of a building are often heated or cooled even though the major portion of the space is not occupied.

There are a number of systems which provide zone heating or cooling for a plurality of work spaces through a centrally located ventilating heating or cooling duct. Typical systems of this type are shown in U.S. Pat. Nos. 4,625,633 issued Dec. 2, 1986 and entitled "Ventilated Core Unit for Service Connection"; 4,378,727, issued Apr. 5, 1983, and entitled "Data Station with Wire and Air Duct"; 4,353,411 issued Oct. 12, 1982, and entitled "Architectural Support and Service Assembly". None of these systems provide for individual control of the work space. In the U.S. Pat. No. 4,646,966, Mar. 3, 1987, and entitled "Personalized Air Conditioning", individual control is provided only for adjusting the air outlets or vents provided in a vertical column which is connected to the centralized air system.

SUMMARY OF THE INVENTION

The present invention relates to a personal environmental module (PEM) that enables each worker to control the air temperature, air flow, noise level, light level and radiant heater at the work station. The PEM is a system by which an individual can control his/her work station environment. The user can control the space temperature, air velocity, noise, light level and air quality in the work station. All PEM's in a work area are networked to a central computer. This computer monitors each PEM to determine work station usage, logs in temperature data at each work station and sends a signal to the air handling unit controller if a change in the air handling unit preconditioned air temperature is needed.

The personalized environmental module is designed to fit under a typical office desk. It is connected to combine air from the central preconditioned air system and the room air. The PEM mixes the preconditioned air with the room air and sends it through small ducts to the work surface where it is discharged into the work space through adjustable diffusers. The diffusers are designed to allow the user to direct the air flow up, down, right or left similar to diffusers in an automobile. Temperature control is achieved by separately controlling the amount of preconditioned air and room air to attain the desired temperature.

The PEM is controlled by a controller which is networked to a personal control panel that is positioned on the desk at a convenient location in the work space. The control panel includes a number of potentiometers which are adjusted by the user to provide the set points for temperature, lights, noise, radiant heat and air flow. The controller senses the space temperature, discharge temperature and air flow, from the PEM and adjusts the PEM to the users set points for temperature and air flow.

One of the principal features of the invention is the provision of a personal environmental module, PEM, that can be conveniently housed under the worker's desk.

Another feature of the PEM is the efficiency of the system by the inclusion of an occupancy sensor which signals the controller to turn down the fan, radiant heater, filter, lights, and noise generator when the work space is unoccupied. When the work space is occupied, the sensor signals the controller to automatically bring the work space up to the set point levels which have previously been set on the control panel by the worker.

A further feature of the PEM is the control of temperature in the work space by combining preconditioned air with room air. This increases the efficiency of the system by reducing the load on the main air handling unit.

A still further feature is the use of separate dampers for the preconditioned air and room air with one damper always fully opened to reduce the air friction losses associated with the dampers which occurs when they are mechanically linked to open and close at the same time.

Other principal features and advantages of the invention will become apparent to those skilled in the art upon review of the following detailed description, claims and drawings.

DESCRIPTION OF A PREFERRED EMBODIMENT OF THE INVENTION

Figure 1:
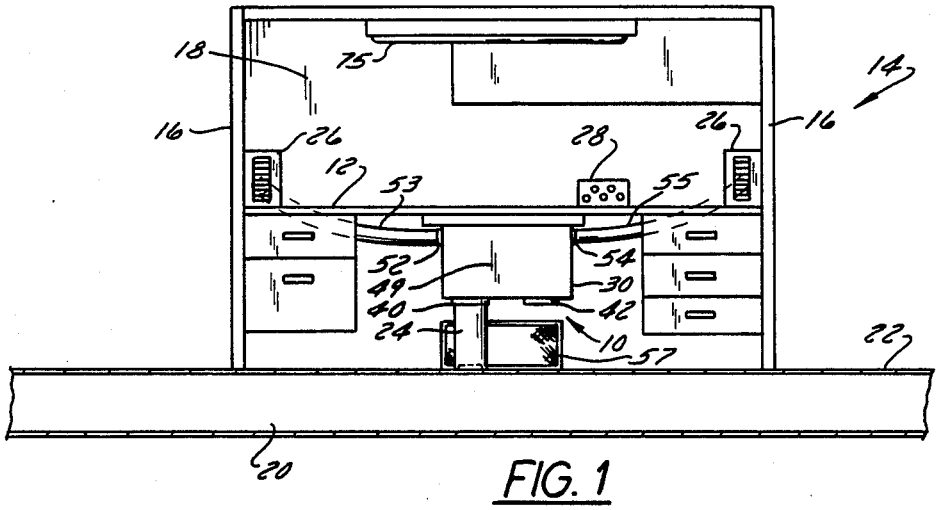
FIG. 1 is a front elevation view of a work station showing the PEM under the desk.
Figure 2:
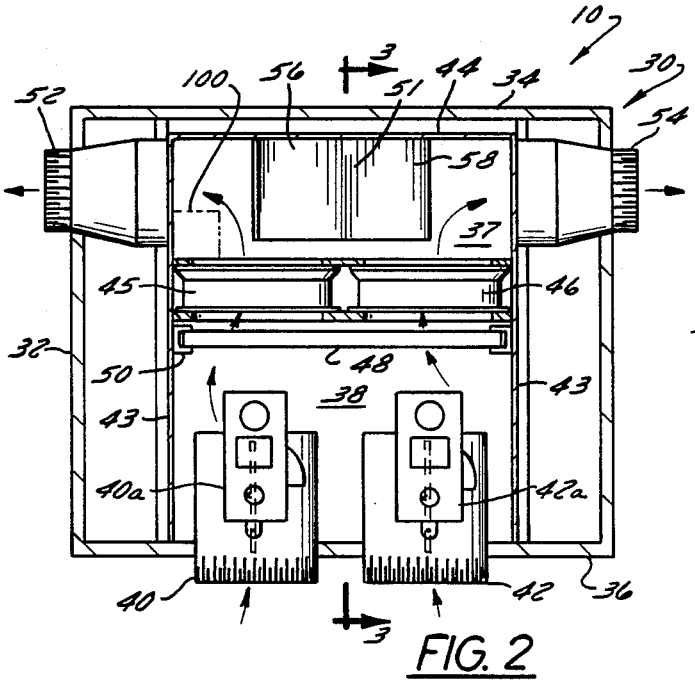
FIG. 2 is a front cross-sectional view of the PEM.
Figure 3:
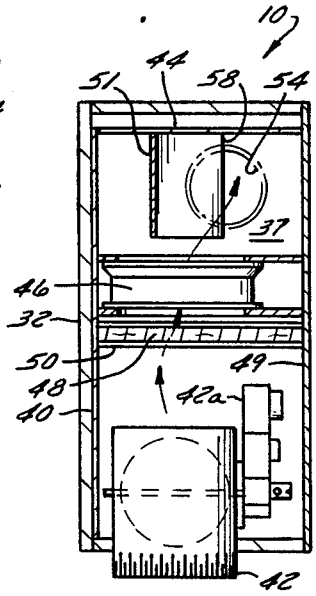
FIG. 3 is a view taken on line 3—3 of FIG. 2 showing the air flow path through the PEM.

The personalized environmental module (PEM) 10 according to the present invention is adapted to be mounted under a desk 12 in a work station 14. The work station 14 is generally closed by side walls 16 which are mounted in a parallel relation on a back wall 18. The module 10 is shown connected to a central air duct or plenum 20 in the floor 22 by means of a pipe 24. It should be noted that the module 10 is not limited to a floor connection but may be connected to an air duct in the wall 18.

Air processed in the PEM 10 is discharged into the work space through vents 26 provided at each side of the top of the desk 12. The module 10 is controlled by means of a control panel 28 located on the top of the desk 12 in a convenient location to the worker. With this arrangement the worker can control the work space temperature, air velocity, light level, noise level and radiant heater temperature if one is provided.

The module 10 includes a housing 30 having a back wall 32, side walls 33 and 35, top 34 and a bottom 36 and front panel 37. A plenum chamber 38 is formed within the housing 30 by back wall 41, side walls 43, a top 44 and a panel 49 that encloses both the front of the plenum chamber 38 and the front of the housing 30. Air is admitted into the plenum chamber 38 by means of a pair of dampers 40, 42 which are mounted in the bottom wall 36 of the housing 30. Air is discharged from the plenum chamber 38 through discharge cones 52 and 54 which are connected to vent 26 by ducts 53 and 55, respectively.

Each of the dampers 40, 42 is a conventional D1510 round type damper made by Johnson Controls, Inc. of Milwaukee, Wis. The dampers are designed to rotate through 80° of rotation. One of the dampers 40 is connected to the central air duct or plenum 20 as described above. The other damper 42 is connected to room air. The dampers 40, 42 are provided with actuating means which can be in the form of electric motors 40*a* and 42*a* to control the dampers 40, 42 respectively. The actuating means are normally set with the dampers in a full open position so that equal amounts of fresh air and room air can be drawn into the module. To increase efficiency of operation, one of the dampers is always at full open and the other damper is adjusted to control air temperature as described hereinafter.

In this regard, having one damper fully open reduces the friction loss associated with the damper which would occur if they are mechanically linked to open and close at the same time. In general, the preconditioned air from the air handling unit will be cooler in the summer than the room air so the supply air damper 40 from the air handling unit will generally be fully open when cooler air is required. If the supply air damper 40 is fully opened the room air damper 42 will be used to adjust air temperature. If the air is too warm, the room air damper 42 will be closed gradually to increase the proportion of preconditioned air to room air and thereby lower the room temperature. If the preconditioned air temperature is greater than the room air temperature, as would commonly occur in winter, the preconditioned air damper 40 will be fully open and the room air damper 42 will be used to lower the room temperature. If at any time the air temperature requirement is beyond the temperature control limits of the PEM, the central processor will note the discrepancy and adjust the preconditioned air temperature up or down to meet the PEM requirement. A minimum quantity of preconditioned air is always provided for ventilation purposes. This is accomplished by adjusting the preconditined air damper so that it can never be fully closed.

Air is drawn through the two dampers 40, 42 by means of two fans 45, 46 axially aligned with and mounted above the respective dampers 40 and 42. Each of the fans 45, 46 is a Comair/Rotron Patriot fan PT2B3 made by Comair Rotron of Saugerteis, N.Y. The fans may be mounted on rubber gaskets for vibration isolation. Although two fans are described herein, a single fan could be used.

An electrostatic filter 48 is mounted on a frame 50 provided around the interior of the plenum chamber 38 and located approximately ½ inch below the fans 45, 46. The filter is made by Cimetic Engineering, Inc. of Ontario, Canada. It is designed to reduce indoor pollution by eliminating pollens and fine dust as well as tobacco smoke, air borne plant spores, fungii, bacteria and some viruses.

Figure 5:
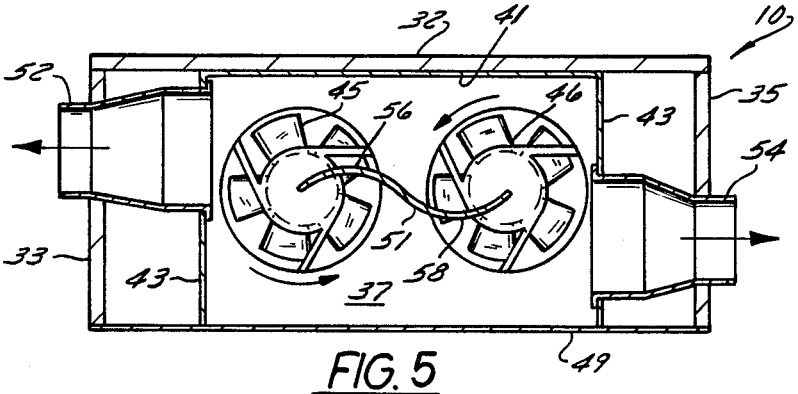
FIG. 5 is a view taken on line 5—5 of FIG. 4 showing the fan arrangement.
Figure 4:
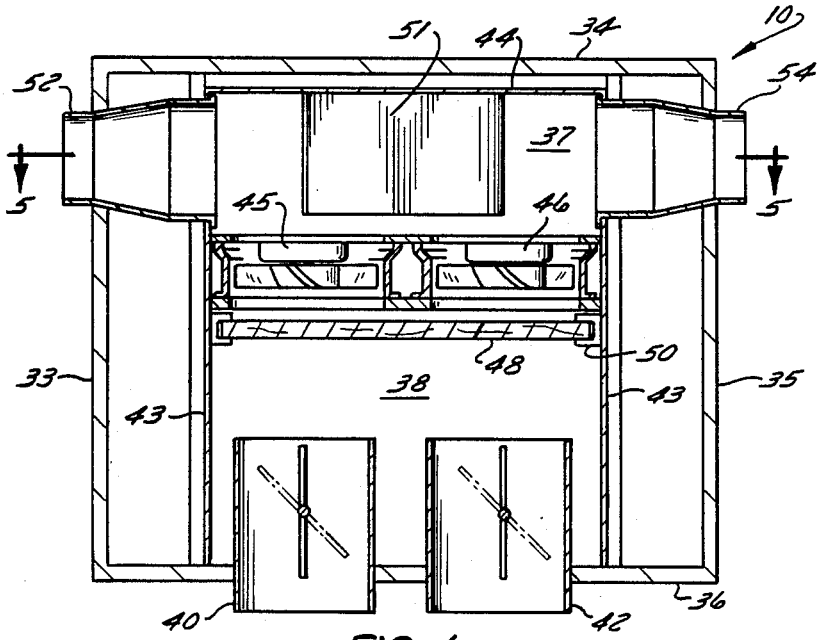
FIG. 4 is a view similar to FIG. 2 showing the interior of the PEM.
Figure 6:
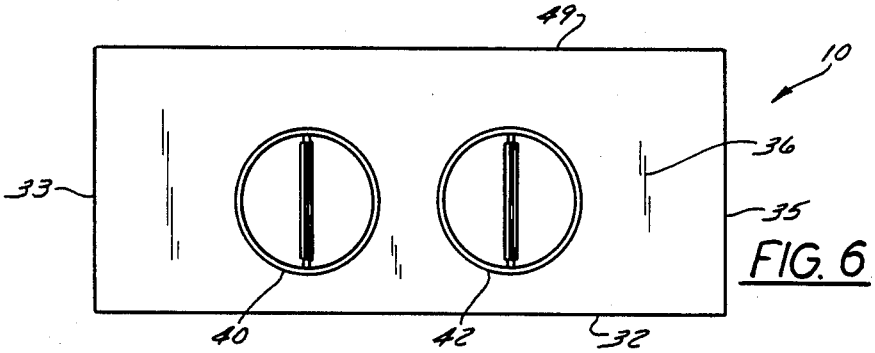
FIG. 6 is a bottom view of the PEM.
Figure 7:
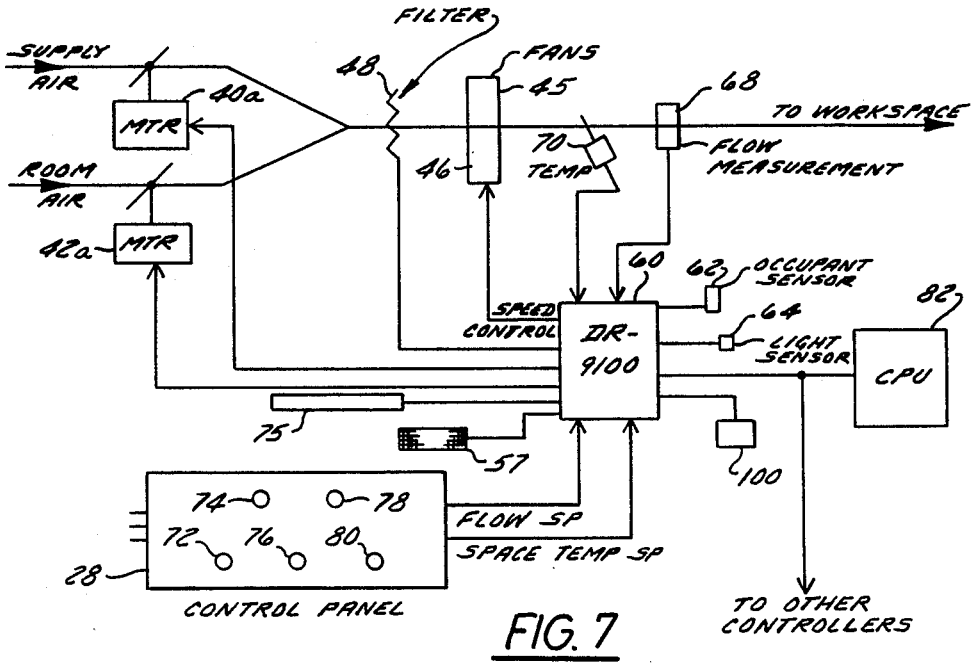
FIG. 7 is a schematic view of the control system.

Means are provided above the fans 45, 46 for mixing the preconditioned air with the room air in the plenum chamber 37. Such means is in the form of a S-shaped baffle 51 which is supported in a vertical relation above the fans 45, 46. Referring to FIGS. 4 and 5 it should be noted that the discharge cones 52, 54 are offset on each side of the axis of the fans 45, 46. The curved surfaces 56 and 58 on the baffle 51 are located in a position to deflect a portion of the air flowing from one fan into the air flow of the other fan.

Referring to FIG. 5, it should be noted that both fans 45, 46 are rotating counterclockwise. The S-shaped baffle 51 is positioned so that curved surface 58 will direct some of the air from fan 45 to flow into the flow path of the air being discharged from the fan 46. Conversely, air from the fan 46 is directed by the curved surface 56 into the air flow path of the air discharged from the fan 45. The air is thus mixed so that air at the same temperature will be discharged through the discharge cones 52 and 54. The baffle 51 surfaces are arranged to provide a flow of air from one fan to the other with no loss in air flow.

Means are provided in the PEM for controlling noise level within the work space. Such means can be in the form of a conventional white noise generator 100 made by Espac in South Bend, Ind. which is positioned in the plenum chamber 38. The noise generator produces a hissing sound which is transmitted through ducts 53 and 55 into the work space. The noise can be adjusted to mask the work space from noise in the adjacent work spaces.

A radiant heater panel 57 may be provided under the PEM for heating the space beneath the desk. The panel 57 is of the type that cycles periodically to generate heat only fifty percent of the time. Lights 75 are provided above the desk 12 for illuminating the top of the desk. The radiant heater panel 57 and the lights 75 are connected to the controller 60.

The PEM is controlled by means of a DR-9100-8143 controller 60 made by Johnson Controls, Inc., Milwaukee, Wis. which is connected to a central processing unit 82. Although this type of controller is described herein, any controller which can be networked to a personal computer can be used. The controller is controlled from a control panel 28 which is positioned on the desk 12 in the work space. The control panel includes a selector means for setting the operating parameters of the PEM. Such means can be in the form of a number of potentiometers 72, 74, 76, 78, and 80 for controlling the noise generator, lights, radiant heat panel, temperature, and air flow, respectively. The potentiometers for the heater 76, temperature 78, and air flow 80 have buffers between them and the controller so that the controller reads an accurate value of the potentiometers. The potentiometers are initially set by the worker to the desired parameters which establish the operating set points for the controller.

The controller 60, as seen in FIG. 4, is connected to an infrared occupancy sensor 62 and a light sensor 66 which are located in the work space. The controller is also connected to an air flow sensor 68 and a temperature sensor 70 which monitor the discharge air flow and temperature into the work space. The temperature sensor 70 could be positioned to monitor the room temperature in the work space if desired. The controller also controls the speed of the fans 45, 46, the operation of the dampers 40, 42 and turns the lights 75, filter 48, radiant panel 57 and noise generator 55 on and off.

The infrared occupancy sensor 62 responds to the heat of a worker in the work space and signals the controller 60 to turn on the fans 45, 46, radiant heater 57, filter 48, lights 75 and white noise generator 55 to the set point levels set on the control panel 28. When the worker leaves the work space, the sensor 62 will signal the controller 60 to turn the lights 75 and noise generator 100 and radiant heater panel 57 off and the fans 45, 46 and filter 48 down to preset minimums.

Figure 8:
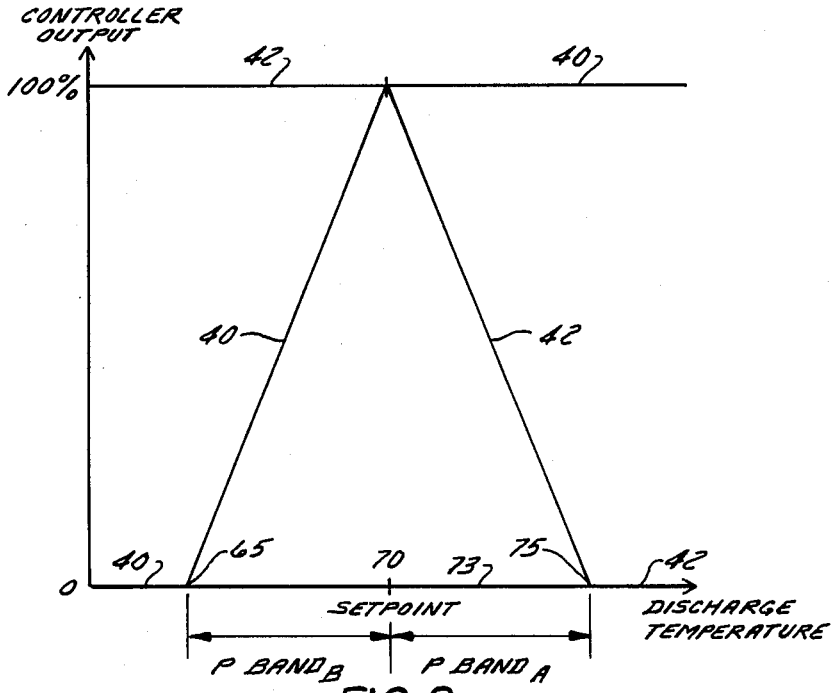
FIG. 8 is a graph of the damper control.

The controller 60, as noted above, is operatively connected to the motors 40*a* and 42*a* to regulate the amount of discharge air flow through the two dampers 40, 42 so that one damper can alway be fully opened. As seen in FIG. 8, a proportional graph is shown for the dampers 40, 42. The system is designed so that both dampers are fully opened to produce the required discharge temperature which will cause the set point and room temperatures to become equal. The preconditioned air from air handling unit will be generally cooler than the room air so the controller 60 will open the preconditioned air damper 40 and will adjust the room air damper 42 by gradually closing the damper 42 if the room temperature is higher than the set point temperature of the potentiometer 78. When the room temperature is lower than set point, the controller 60 would open room air damper 42 and adjust the preconditioned air damper 40 to return the room temperature to set point.

Assuming an air temperature difference of 10° F., preconditioned air 65° F., room air 75° F., and a set point of 70° F., both dampers would be fully opened. If, however, the set point temperature is raised to 73° F., the preconditioned air damper 40 is gradually closed to decrease the amount of preconditioned air until the room temperature matches the set point temperature.

The controller 60 controls the speed of the fans 45 and 46 by matching the discharge air flow sensed by sensor 68 with the set point air flow set by the worker on the potentiometer 80.

One of the unique features of the invention is the absence of any numerical indicia on the control panel. The potentiometers in the control panel are designed to allow the worker to adjust the potentiometers to achieve a comfortable environment without referring to any numerical indicia. If the temperature, air flow, noise or lights are not satisfactory, the worker merely adjusts the appropriate potentiometer. The controller automatically senses the set point change and adjusts the corresponding system to meet the change.

Thus it is apparent that there has been provided, in accordance with the invention, a personal environmental module that fully satisfies the aims and advantages set forth above. While the invention has been described in conjunction with specific embodiments thereof, it is evident that many alternatives, modifications and variations will be apparent to those skilled in the art. Accordingly, it is intended to embrace all such alternatives, modification and variations as fall within the spirit and broad scope of the appended claims.

We claim:

1. A personal environmental module for a work space, said module comprising:

a housing having a pair of air inlets and one or more air outlets positioned to discharge air into the work space, a controlled damper mounted in each of said air inlets, one of said air inlets being connected to a preconditioned air source and the other of said air inlets being connected to room air, means mounted in said housing for drawing air through each of said air inlets for discharge through said air outlet, and baffle means in said housing for mixing the predconditioned air and room air prior to discharge through said air outlet.

2. The module according to claim 1 wherein said housing includes a plenum chamber and said air outlets comprises a diffuser on each side of said plenum chamber.

3. The module according to claim 2 wherein said drawing means comprises a pair of fans.

4. The module according to claim 3 wherein said baffle means is mounted in said plenum chamber in a position to direct air from one fan into the air discharged from the other fan and air from the other fan into the air discharged from the said one fan.

5. The module according to claim 4 wherein said baffle means is in the form of an S-curved member mounted in close proximity to said fans.

6. The module according to claim 5 including a controller connected to control the speed of said fans and a control panel in the work space operatively connected to said controller, said control panel including means for setting the speed of said fans.

7. The module according to claim 6 wherein each of said dampers includes an actuator, said controller being connected to control one or the other of said actuators in response to the temperature requirements of the work space, and said control panel including means for setting the temperature of said work space.

8. The module according to claim 7 including a white noise generator in said plenum chamber, said generator being connected to said controller and said control panel including means connected to said controller for adjusting said noise generator.

9. The module according to claim 8 including an electrostatic filter in said plenum chamber, said filter being connected to said controller and a heater panel in said module, said panel being connected to said controller, said control panel including means connected to said controller for adjusting said heater panel.

10. The module according to claim 9 wherein said controller includes means for sensing the presence of an occupant in the work space, said controller being operatively connected to said sensing means to turn said fans, filter, and noise generator on when the work space is occupied and off when the work space is not occupied.

11. A personal environmental module for an independent work space having a desk therein, said module comprising:

a housing adapted to be mounted in the work space beneath the desk, said housing including a plenum chamber having a pair of air inlets and a pair of air outlets, means for connecting said air outlets to the work space, a damper mounted in each of said air inlets, each of said dampers including actuating means for opening and closing said dampers, one of said air inlets being connected to a preconditioned air source, the other of said air inlets being connected to room air, means in said housing for drawing air through said air inlets for discharge into said plenum chamber, and a controller operatively connected to said actuating means for selectively opening one of said dampers and controlling the opening and closing of the other of said dampers whereby the air drawn through one of said air inlets will be mixed with air drawn through the other of said air inlets to adjust the temperature of the air in the work space.

12. The module according to claim 11 wherein said drawing means comprises a pair of fans aligned with each of said dampers.

13. The module according to claim 12 including a control panel operatively connected to said controller, said control panel including means for selecting a desired air temperature and said controller including sensing means for monitoring the temperature of the discharge air whereby said controller will adjust said dampers so that the discharge air temperature matches the desired air temperature.

14. The module according to claim 13 including a baffle mounted in said plenum chamber for mixing some of the room air from one damper with the preconditioned air from the other damper and some of the preconditioned air from the other damper with the room air from said one damper prior to discharge through said outlets.

15. The module according to claim 14 wherein said baffle is mounted in close proximity to said fans and has an S-shape for directing air from each fan toward the other fan.

16. The module according to claim 15 wherein said controller is operatively connected to control the speed of said fans and includes sensing means for monitoring the air flow through said air outlets, and said control panel includes means for selecting a desired air flow whereby said controller preconditioned air and room air will be mixed before discharge into the work space.

17. The module according to claim 16 including means in said plenum chamber for masking noise in said work space.

18. A personal environmental module for controlling the environment in a work space, said module comprising:

a housing having a pair of air inlets and one or more air outlets, a pair of dampers in said air inlets, each damper including an actuating means for controlling the flow of air through said damper, one of said air inlets being connected to a preconditioned air source and the other of said air inlets being connected to draw air from the room, a pair of fans mounted in said housing in a spaced relation to said dampers for drawing air through said air inlets, an electrostatic filter mounted in said housing between said fans and said dampers for filtering air discharge from said air outlets, a white noise generator mounted in said housing for masking noise in the work space, controller means operatively connected to control said damper actuating means, said fans, said noise generator and said filter, and a control panel operatively connected to said controller means, said control panel including selector means for setting the operating parameters for said damper actuating means, fans, noise generator and filter.

19. The module according to claim 18 including a baffle mounted in said housing to direct a portion of the air discharged from one fan into the air flow path of the other fan and a portion of the air from the other fan into the air flow of said one fan whereby the preconditioned air and room air will be mixed before discharge into the work space.

20. The module according to claim 19 including an occupancy sensor positioned in the work space to sense the presence of an occupant in the work space, said sensor being operatively connected to said controller means whereby said controller means will turn on said fans, noise generator and filter.

* * * * *

UNITED STATES PATENT AND TRADEMARK OFFICE
Certificate

Patent No. 4,872,397 Patented: October 10, 1989

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is:
Michael G. Demeter, Paul E. Wichman, Linda S. Endres, Charles E. Rohrer, Peter A. Donaldson Mill, David N. Abjudom, II.

Signed and Sealed this Twenty-eighth Day of August 1990.

ALBERT J. MAKAY

*Supervisory Primary Examiner*
*Art Unit 344*